United States Patent [19]

Rolland

[11] 4,337,637

[45] Jul. 6, 1982

[54] PARALLEL POSITIONING DEVICE

[75] Inventor: Burton A. Rolland, Zionsville, Ind.

[73] Assignee: Hurco Manufacturing Company, Inc., Indianapolis, Ind.

[21] Appl. No.: 190,732

[22] Filed: Sep. 25, 1980

[51] Int. Cl.[3] ..... B21D 11/22

[52] U.S. Cl. ..... 72/461; 72/389; 81/467

[58] Field of Search ..... 72/461, 389, 386, 446, 72/419; 83/467, 468, 318, 320

[56] References Cited

U.S. PATENT DOCUMENTS

| | | | |
|---|---|---|---|
| 1,366,409 | 1/1921 | Munschauer | 269/318 |
| 3,115,801 | 12/1963 | Pearson | 83/467 A |
| 3,618,349 | 11/1971 | Roch | 72/36 |
| 3,824,822 | 7/1974 | Richardson | 72/461 |
| 3,826,119 | 7/1974 | Marotto | 72/461 |
| 3,892,155 | 7/1975 | Gerlach | 83/460 |
| 4,084,424 | 4/1978 | Roch | 72/461 |

*Primary Examiner*—Gene Crosby

*Attorney, Agent, or Firm*—Woodard, Weikart, Emhardt & Naughton

[57] ABSTRACT

A pair of arms having mounting pads affixed at one end of each arm, is mounted to a press brake bed. Gauge support members are guidingly received on the arms to support a gauge bar or other gauge mounting surface for workpiece locating stops. The gauge is to be moved and maintained with the gauging edge parallel to the press brake mounting faces of the pads, and thereby, parallel to the tooling of the press brake. One of the gauge support members is driven by a motor and drive screw, and connected through flexible non-extensible tensile members to drive the other gauge support in synchronism, and thereby position the two gauge support members simultaneously and at equal distances from the press brake tooling.

23 Claims, 3 Drawing Figures

PARALLEL POSITIONING DEVICE

BACKGROUND OF THE INVENTION

1. Field of the Invention

This invention relates generally to mechanical positioning apparatus and, more particularly, to apparatus for simultaneously moving two fixed points which are in spaced relation to each other, in a single direction uniformly toward and away from a reference line perpendicular to the direction of motion.

2. Description of Prior Art

The site of primary interest to me, for utilization of the present invention, is workpiece locating apparatus for presses. For example, in U.S. Pat. No. 3,618,349 issued Nov. 9, 1971 to Gerald V. Roch, and assigned to the assignee of the present invention, there is shown a metal-bending press, more typically known in this country as a press brake, with workpiece locating gauge assemblies behind and in front of the metal forming tools in the press brake. The forming tools are normally elongated, extending in a direction perpendicular to the general direction of insertion of the workpiece into and removal from the press brake, to make various bends in the workpiece.

For some workpieces, the bend must be made along a rather long line from one edge to the other edge of a sheet. In such instances, the sheet is so wide that accurate gauging dictates contact with the sheet at points at least reasonably near the edges of the sheet. This normally requires a considerable horizontal spacing between support points for the gauges themselves. Also, where front gauging is to be used, it is desirable that the machine operating person be able to approach the press between gauge supports such as is possible between the front gauging assemblies 16 and 17 in the above mentioned Roch patent. In these instances, some means must be provided for assuring that the movement of the gauges toward and away from the forming tools for any given bend will be uniform, so that both gauges will stop movement at the same distance from the forming tools. For this purpose, in the pneumatically driven gauges of the above-mentioned Roch patent, a hydraulic master-slave relationship was established to provide the synchronism of movement. A cross shaft, chain and sprocket assembly is employed for synchronism of pneumatic pistons in U.S. Pat. No. 3,824,822 issued July 23, 1974. Some subsequent gauging systems have employed motor-driven screws, rather than pneumatic cylinders, to drive the gauges. In an early, non-motorized gauge for shears, shown in U.S. Pat. No. 1,366,409, issued Jan. 25, 1921, a single handle could be employed to drive two screws, using gearing to drive the gauges or gauge supports in synchronism. Another example of this is present in U.S. Pat. No. 3,115,801 issued Dec. 31, 1963. Another approach has been to employ two motors and screw drives for gauge supports, wherein electronic control means are employed for synchronizing the motor drive, to synchronize the gauge movement and stop positions. This is disclosed in U.S. Pat. No. 4,084,424 issued Apr. 18, 1978 to Gerald V. Roch et al. There has remained a need for synchronizing the movement and positioning of gauge supports, with comparable reliability but with less expense. The present invention is directed to that objective.

SUMMARY OF THE INVENTION

Described briefly, according to a typical embodiment of the present invention, a positioning device is provided including mounting means for mounting the device to some type of base wherein there is some reference line, and the mounting means supports two members to be moved and positioned uniformly toward and away from the reference line. Power drive means are employed on the mounting means and connected to at least one of the members for driving it, with the other of the members being coupled to the one by means of flexible tensile elements arranged to provide uniform simultaneous movement and synchronized positioning of the two members with respect to the reference line.

DESCRIPTION OF THE PREFERRED EMBODIMENT

Figure 1:
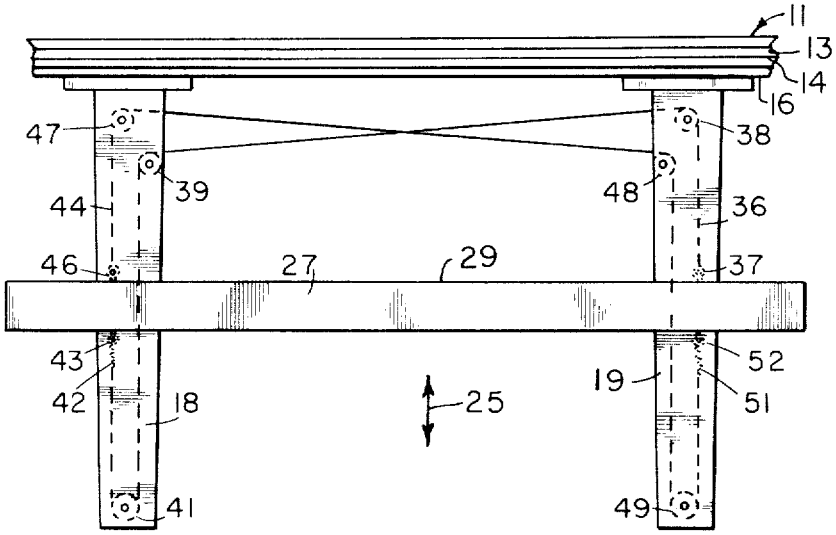
FIG. 1 is a schematic top plan view of a parallel positioning device according to a typical embodiment of the present invention as applied to a press brake.
Figure 2:
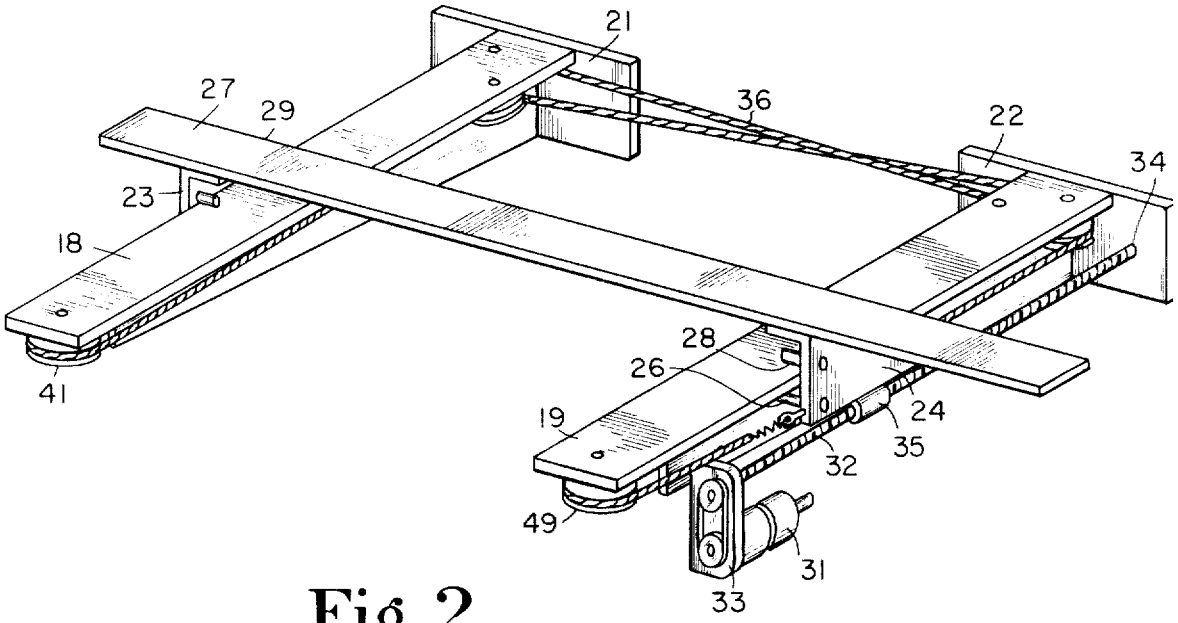
FIG. 2 is an enlarged perspective view of a positioning device according to a typical embodiment of the invention.

Referring now to the drawings in detail, FIG. 1 shows a press brake bed 11, having lower tooling die 13 thereon with the bottom of the Vee of the die being shown at 14 and which may be referred to hereinafter as a tooling reference line. This line is normally horizontal and lies in a vertical plane. The press brake bed has a face 16 to which the device of the present invention is secured, and this can be a front face or rear face, because the present invention, as applied to press brakes, can be mounted to the front face, in the case of front gauge mountings, or to the back face, in the case of back gauge application. Since a gauge bar is more often used in the back gauge application, the particular illustrations shown in FIGS. 1 and 2 may be referred to as those for a back gauge, mounted to a back face 16 of the press brake bed, although it will be readily recognized that the present invention could be equally well applied to mounting of front gauges where there is no gauge bar between horizontally spaced gauge supports.

Referring further to the drawings, two arms 18 and 19 are respectively affixed to mounting pads 21 and 22 affixed to the face 16 of the press brake bed. Carriage members 23 and 24 (FIG. 2) are mounted on the arms 18 and 19, respectively, and supported by suitable bearing rollers such as 26 and 28 (four on each of the members 23 and 24) to permit free movement of the carriage members in the direction of the arrows 25, toward and away from the press brake tooling.

Gauge bar 27, having a front gauging face 29, is supported on these carriage members, and the synchronized movement of the carriage members is provided according to the present invention to maintain parallelism of the gauge bar face 29 with the press brake tooling reference line 14. More specifically, the important thing is to provide parallelism of face 29 with a plane perpendicular to the direction 25, and in which the tooling reference line 14 is contained. With the apparatus in the normal orientation shown, this plane may be the above-mentioned vertical plane.

A drive motor 31 is affixed to arm 19. It drives a screw 32 which extends from the motor reduction gear box 33 to a suitable end bearing 34 in pad 22. A ball nut 35, mounted to the gauge carriage 24, is moved toward and away from the press brake as the motor drives the screw in one or the other rotational direction.

In order that the gauge carriage member 23 is driven in synchronism with member 24, elongated flexible but preferably non-stretchable connector elements such as a rope, chain or cable arrangement with sprockets or pulleys can be employed as shown. For this purpose, chain or gear belt 36 is affixed to carriage 24 by a connector 37. It passes around sprocket 38 at arm 19, and across and around sprocket 39 at arm 18, and out to sprocket 41 at the distal end of arm 18, and then to a spring or adjustable connector 42 affixed to carriage 23 at 43. Another gear belt 44 is affixed to carriage 23 at 46, and extends around the sprockets 47, 48 and 49 to the spring or adjustable connector 51, which is affixed to carriage 24 at 52. The attachments at the fixed connection points 37 and 46 can be made by screw connectors with jam nuts and lock nuts. The same is true for the connections of the spring connectors 42 and 51 at 43 and 52, where the connectors can be connector screws with appropriate locating nuts and jam nuts. Other types of connection can be employed. For example, turnbuckles could be employed at the locations 37, 46, 43 and 52, if desired. Although the drawings herein show springs 42 and 51 for adjustment of tension of the gear belt, this tension adjustment could also be provided by an adjustable pre-load device or an adjustable spring which would have sufficient force to over-compensate for the inertial force of the mechanism, plus the maximum force an average machine operator could manually apply to the mechanism. Therefore, it should be recognized that tension maintaining devices other than springs, may also be used.

From the foregoing description, it will be recognized by those skilled in the art, that pads 21 and 22 could be bolted directly to the press brake bed, or could be bolted to slides in slideways of the press brake bed as was the case in the above-mentioned Roch U.S. Pat. No. 3,618,349, or could be mounted to speed rails as in the above-mentioned Roch et al. U.S. Pat. No. 4,084,424. In the latter event, if changes are to be made in arm-to-arm spacing, accommodations would be needed in terms of belt length but which could be easily handled by quick-connect or disconnect features at the connection points 37, 46, 43 and 52. Other types of mountings of the arms 18 and 19 could be employed. In addition, it should be noted that, in the illustrated embodiment, the arms are of T-shaped cross section. The guide rollers 26 and 28 bear on bottom and top faces of the top flange plates (horizontal portions of the T) of the arms, while the vertical supporting web or rib of each arm, or the outboard edge of the flange plate, can be used as a transverse guide for the carriage member. This can be done with additional rollers on the carriage members 23 and 24 as, and if desired. The important point is that the arms 18 and 19 serve as supporting guideways for the carriage members 23 and 24, respectively, as they move in and out in the direction of arrows 25 as driven by the screw 32 and the connecting drive belts or cables. Accordingly, the bar 29 is not needed at all for maintaining orientation or synchronization of the movements of the carriage members 23 and 24. Their proper orientation, in terms of lateral and vertical support, is established by the arms 18 and 19. Their proper positioning with respect to the reference line 14 of the press brake, is established by the screw drive of carriage 24 and the synchronizing belt connection to carriage 23. It will be seen that, for proper positioning with respect to line 14 in the press brake, the carriage members will be properly positioned with respect to any reference line in the positioning device and which is parallel to line 14 and passes through the stationary portions of the positioning device and lies in a reference plane perpendicular to the direction (arrow 25) of the guideways. An example is a line containing the front faces of the pads 21 and 22 and lying in a plane perpendicular to direction 25 (which is also perpendicular to the outboard edges of the top flanges of arms 18 and 19). Thus, it will be seen that this invention can also be applied to machines other than press brakes and to devices other than gauges, and to devices other than those where a member (such as 27 herein) would be mounted to which are driven and positioned in synchronism.

Figure 3:
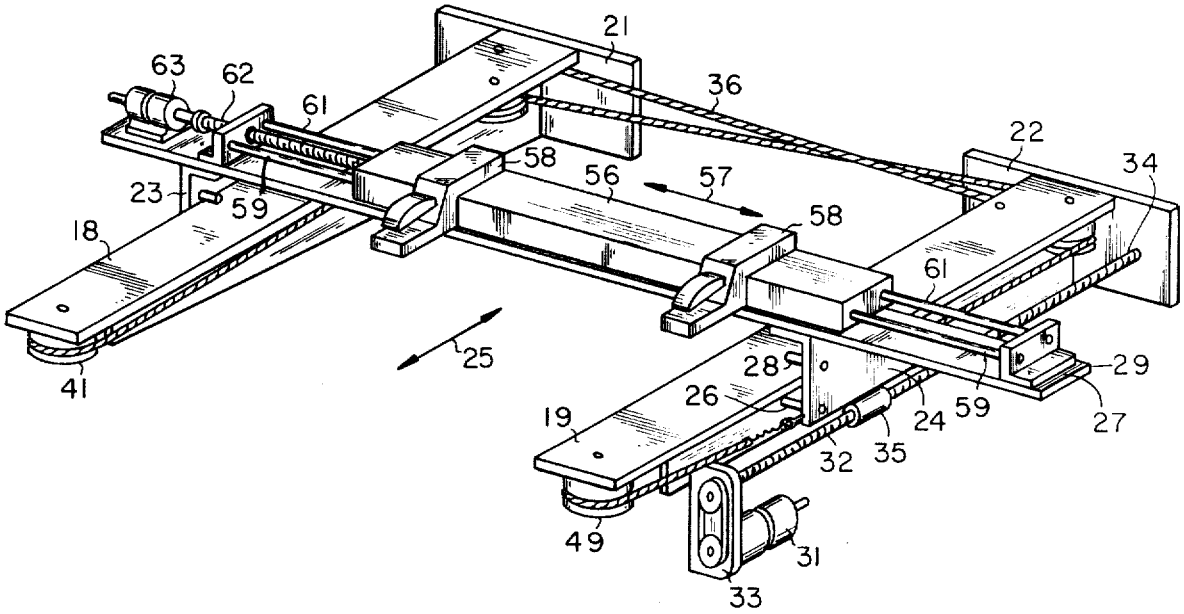
FIG. 3 is a perspective view of the basic structure of FIG. 2, but with an additional carriage and grippers to provide both X-axis and Y-axis positioning of grippers.

Referring now to FIG. 3, the structure is essentially the same as that described previously. However, in this instance, the bridging member has mounted to it a carriage 56 movable along member 29 in the direction of arrows 57 perpendicular to the direction of arrows 25. These may be referred to as the X and Y-axis coordinates of an X-Y positioning system for grippers 58 secured to the carriage 56. The carriage may incorporate ball bushings therein, received on guide rods 59 and 61 affixed to the member 29. The carriage 56 is drivable in the X-axis directions by a lead screw 62 threadedly received in a ball nut (not shown) in the carriage, upon operation of the X-axis drive motor 63.

In this example, the mounting pads 21 and 22 may be mounted to a suitable portion of the frame or base of a punch-press or other machine where the grippers 58 are gripping a sheet of metal to move it as needed in the X-Y directions for punching holes or patterns or the like. This is just another example of the variety of ways in which the Parallel Positioning Device of the present invention, can be employed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A positioning device comprising:

mounting means for mounting the device to a base and securing the device in a fixed position on the base;

first and second separately guided means supported by said mounting means for movement in a predetermined direction toward and away from a reference line established by said mounting means;

drive means on said mounting means and coupled to said first guided means for moving said guided means in said direction; and elongated connector means coupled between said first and second guided means to pull said second guided means in said direction in synchronism with movement of said first guided means in said direction.

2. The device of claim 1 wherein:

said mounting means include first and second elongated guiding means having, respectively, first and second elongated guideways thereon extending in said direction, with said first and second guided means being mounted on said first and second guideways, respectively, for guided movement thereon in said direction toward and away from said reference line in response to driving operation of said driving means.

3. The device of claim 2 wherein:

said mounting means include first and second pads securable to the bed of a bending press, said first and second guiding means being affixed at one end thereof to said first and second pads, respectively.

4. The device of claim 2 wherein:

said drive means include an elongated screw parallel to said guideways and a nut connected to said first guided means and threadedly receiving said screw therein, and a drive motor connected to said screw for rotational drive of said screw to drive said nut and thereby drive said first guided means linearly along said first guideway.

5. The device of claim 1 wherein:

said elongated connector means include first and second tensile elements, each having one end affixed to one of said first and second guided means, and each having an opposite end connected to the other of said first and second guided means, one of the ends of each of said tensile elements being connected to its respective one of said first and second guided means by resilient means.

6. The device of claim 5 wherein:

said tensile elements are constantly in a state of tension established by said resilient means at one end thereof.

7. The device of claim 6 wherein:

said resilient means include a relatively stiff spring connected between said guided means and said end of said tensile element.

8. The device of claim 1 wherein:

said drive means include an elongated screw extending in said direction, and a nut connected to said first guided means and threadedly receiving said screw therein, and a drive motor connected to said screw for rotational drive of said screw to drive said nut and thereby drive said first guided means linearly in said direction.

9. The device of claim 8 wherein:

said connector means are so arranged, and said drive motor is reversible, to drive both of said guided means toward and away from said reference line.

10. The device of claim 8 wherein:

said mounting means include mounting surface means for engagement with the base to which the mounting means is to be secured, and said mounting means include first and second elongated guideways, with said first and second guided means being mounted on said first and second guideways, respectively, for guided movement thereon in said direction toward and away from said reference line in response to driving operation of said drive motor.

11. The device of claim 10 and further comprising:

pulley means on said mounting means, said elongated connector means being extended around said pulley means;

said pulley means comprising first, second, and third pulleys mounted on said mounting means adjacent said first guideway, and fourth, fifth and sixth pulleys mounted on said mounting means adjacent said second guideway, said connector means including a first tensile element connected from said first guided means around said third pulley and fifth pulley and fourth pulley through a resilient connector to said second guided means, and said connector means including a second tensile element connected from said second guided means around said sixth pulley, and second pulley, and said first pulley through a resilient connector to said first guided means.

12. The device of claim 11 wherein:

said reference line lies in a plane perpendicular to said direction and intercepts said mounting surface means;

said second, third, fifth and sixth pulleys are adjacent said plane; and said first and fourth pulleys are adjacent ends of said guideways remote from said plane.

13. The device of claim 12 wherein:

said mounting means include first and second generally parallel, horizontally disposed and spaced elongated guide arms, said arms being of generally T-shaped cross section and having said mounting surface means at one end thereof, said first guideway being provided on an outboard edge of the horizontal portion of the T of said first arm and on upper and lower faces of said horizontal portion adjacent the outboard edge, said second guideway being provided on an outboard edge of the horizontal portion of the T of said second arm and on upper and lower faces of said horizontal portion adjacent the outboard edge.

14. The device of claim 13 wherein:

said guided means include guide rollers engaging the guideways on said horizontal portions of the T's of said arms.

15. The device of claim 1 wherein:

said guided means support a workpiece locating gauging surface.

16. The device of claim 15 and further comprising:

an elongated transverse rigid member secured to said first and second guided means.

17. The device of claim 16 wherein:

said transverse member is a bar having a gauging surface extending parallel to said reference line.

18. The device of claim 15 and further comprising:

a machine press base;

a forming tool on said base and establishing a vertical tool-reference plane;

said mounting means being affixed to said base so as to place said reference line in a plane parallel to said tool-reference plane.

19. The device of claim 18 wherein:

said mounting means include first and second elongated guiding means having, respectively, first and second elongated guideways thereon extending in said direction, with said first and second guided means being mounted on said first and second guideways, respectively, for guided movement thereon in said direction toward and away from said reference line in response to driving operation of said driving means.

20. The device of claim 19 wherein:

said guided means and guideways are horizontally spaced sufficiently for an operating person to stand between them.

21. The device of claim 20 and further comprising:

an elongated transverse rigid member secured to said first and second guided means.

22. The device of claim 21 wherein:

said transverse member is a bar having a gauging surface extending parallel to said reference line; said gauging surface of said bar facing said tool reference plane and being the said workpiece locating gauging surface.

23. The device of claim 1 wherein:

said guided means support a carriage and second drive means for said carriage, said second drive means being coupled to said carriage to move said carriage in a direction parallel to said reference line, said carriage having grippers thereon.

* * * * *